US007357972B2

(12) United States Patent
Best

(10) Patent No.: US 7,357,972 B2
(45) Date of Patent: Apr. 15, 2008

(54) SUPPORT AS OR FOR A PAPER MACHINE CLOTHING

(75) Inventor: Walter Best, Duren (DE)

(73) Assignee: Heimbach GmbH & Co, Duren (DE)

( * ) Notice: Subject to any disclaimer, the term of this patent is extended or adjusted under 35 U.S.C. 154(b) by 353 days.

(21) Appl. No.: 10/922,161

(22) Filed: Aug. 20, 2004

(65) Prior Publication Data

US 2005/0233111 A1 Oct. 20, 2005

(30) Foreign Application Priority Data

Aug. 21, 2003 (EP) ..... 03019005

(51) Int. Cl.
*B32B 3/24* (2006.01)
*D21F 3/04* (2006.01)
*D21F 7/08* (2006.01)

(52) U.S. Cl. ..... 428/131; 428/99; 428/223; 162/358.2; 162/900; 162/902

(58) Field of Classification Search ..... 428/131, 428/99, 223; 162/358.2, 900, 902
See application file for complete search history.

(56) References Cited

U.S. PATENT DOCUMENTS 4,323,622 A * 4/1982 Gladh et al. ..... 442/324
4,440,598 A * 4/1984 Koski et al. ..... 162/305
6,462,145 B1 * 10/2002 Fleri et al. ..... 525/444
2003/0126724 A1 * 7/2003 Kono et al. ..... 24/451
2003/0190451 A1 * 10/2003 Baker et al. ..... 428/99

FOREIGN PATENT DOCUMENTS

| | | |
|---|---|---|
| EP | 0 802 280 | 10/1997 |
| WO | WO 9917630 A1 * | 4/1999 |
| WO | WO 01/98580 | 12/2001 |

* cited by examiner

*Primary Examiner*—William P Watkins, III
(74) *Attorney, Agent, or Firm*—Berenato, White & Stavish

(57) ABSTRACT

A liquid-permeable support for a paper machine clothing that is usable in the press section of a paper machine includes a support having at least two plies that brace against one another via discrete bracing elements. At the points where the plies brace against one another, there is applied on one or both sides an elastic coating which is embodied elastically in such a way that the spacing of the plies under pressure loading is decreased by elastic compression of the coating. Upon pressure relief the spacing is increased again by elastic recovery of the coating.

16 Claims, 1 Drawing Sheet

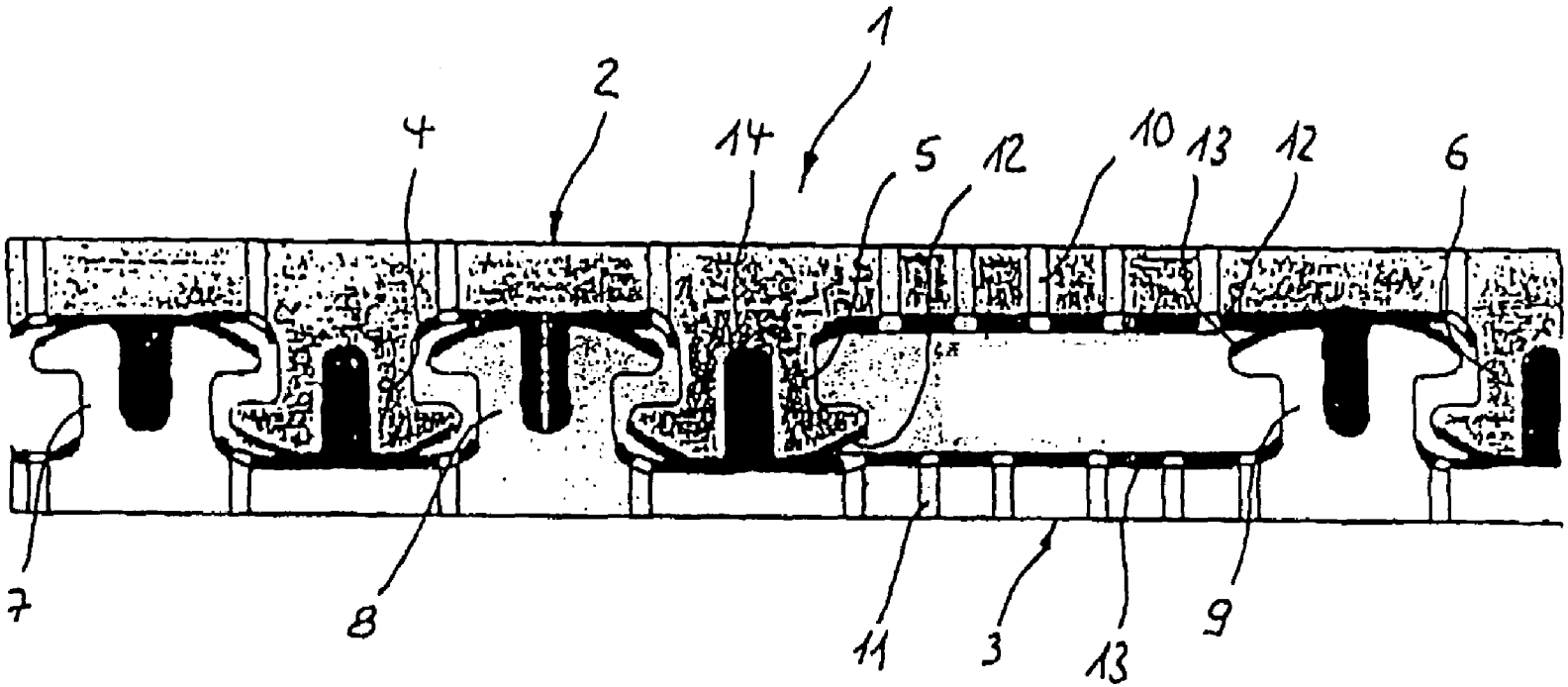
1
2
4
5
6
7
8
9
10
11
12
12
13
13
14
3

SUPPORT AS OR FOR A PAPER MACHINE CLOTHING

CROSS-REFERENCE TO RELATED APPLICATIONS AND CLAIM TO PRIORITY

This application claims priority pursuant to 35 U.S.C. § 119 to application number 03 019 005.2, filed Aug. 21, 2003, with the European Patent Office, the disclosure of which is incorporated herein by reference.

FIELD OF THE INVENTION

The invention concerns a liquid-permeable support as or for a paper machine clothing that is usable in the press section of a paper machine, the support having at least two plies that brace against one another via discrete bracing elements.

BACKGROUND OF THE INVENTION

Paper machine clothings that are suitable for guiding the paper web through the press section of a paper machine are conventionally embodied as press felts. Such press felts have a support made up of a woven or knitted fabric or a yarn layer, onto which a nonwoven fabric is needle-felted so that the clothing has a felt-like character. Proposals have recently been made to replace the press felts with a paper machine clothing that is assembled from two (or more) extruded webs laid on top of one another, the webs bracing against one another via discrete bracing elements of a wide variety of conformations (cf. EP 0 802 280 A2; WO 01/98580). The bracing elements are also configured during the extrusion process. They are shaped in such a way that they engage into and fit behind one another. They determine the spacing between the two webs. The webs themselves are of porous configuration, so that the liquid pressed out of the paper web in the press can pass through the webs and the paper web is thereby dewatered. Nonwoven layers that are joined to the webs can be applied onto the outer sides of the two webs. In this case the structure made up of the webs and bracing elements forms a support for the nonwoven layers.

Such paper machine clothings have the property that they initially dewater the paper web very well in the front part of the press nip. In the rear part of the press nip, however, a re-wetting of paper web occurs because of the press pressure that continuously or suddenly weakens there, i.e. water flows back into the paper web out of the support and the paper-side nonwoven fabric. The dewatering performance of the paper machine clothing is thereby considerably reduced.

It is the object of the invention to configure a support of the kind cited initially in such a way that re-wetting of the paper web in the rear portion of the press nip is substantially lowered or in fact entirely avoided.

SUMMARY OF THE INVENTION

This object is achieved, according to the present invention, in that at the points where the plies brace against one another, there is applied on one or both sides an elastic coating which is embodied elastically in such a way that the spacing of the plies under pressure loading is decreased by elastic compression of the coating, and upon pressure relief is increased again by elastic recovery of the coating. When a support embodied in this fashion is placed under pressure in the press, the result is a reduction in the thickness of the support and thus a decrease in the open volume between the two plies. The pressure weakens in the rear part of the press nip, and the spacing between the plies instantaneously recovers elastically to the initial state. The water-filled open volumes between the plies are thereby enlarged, thereby creating a water-free space in the region of the paper-web-side ply that delays the return flow of water, and in fact draws water out of the paper-side nonwoven fabric into the support, until the paper web has been separated from the paper machine clothing. The speed of the recovery process after leaving the press nip can be controlled by adjusting the elasticity so that the most optimum possible effect occurs. The coating can be made of rubber, polyurethane, or another elastomer, for example a silicone elastomer.

The plies and bracing elements are advantageously shaped so that they can be manufactured from plastic as extruded webs. Suitable plastics are principally polyamide-6, -6,6, -6,10, -6,12, or -12, or PTT, but also other plastics such as those set forth, for example, in claims 16 through 23 of WO 01/98580 A1.

In order for the support to be liquid-permeable, it should be provided with a grid of perforations that can be produced, for example, using a laser. The permeability can be adapted individually to the particular circumstances by way of the size and the number of the perforations per unit area.

The bracing elements are advantageously embodied in such a way that they fit one behind another, so that joining of the layers is accomplished via the bracing elements themselves. The bracing elements can be embodied in mirror-image fashion but arranged with an offset from each other. To allow them to be shaped along with the respective web by extrusion, the bracing elements should be embodied as bracing struts extending in the longitudinal direction, i.e. the extrusion direction, of the support.

The bracing elements can be curved at their free ends. A mushroom-like or arrow-like cross section is particularly useful, since struts that can fit behind one another are thereby constituted.

Provision is further made according to the invention for the bracing elements to comprise a notch that advantageously is filled with the material of the elastic coating. It can furthermore be useful if the bracing elements have differing spacings.

DESCRIPTION OF THE DRAWINGS

FIG. 1 is a fragmentary cross-sectional view of a support for a paper machine clothing according to the invention

DETAILED DESCRIPTION OF THE PREFERRED EMBODIMENT(S)

The invention is illustrated in more detail, with reference to an exemplary embodiment, in the drawing, which shows a partial cross section through a support 1 for a paper machine clothing that is to be used in the press section of a paper machine. Support 1 comprises two extruded webs 2, 3 that are embodied in mirror-image fashion. Webs 2, 3 comprise bracing struts 4, 5, 6 and 7, 8, 9, mushroom-shaped in cross section, that extend perpendicular to the drawing plane and thus in the extrusion direction. They are arranged so that they fit behind one another with their lateral projections after having previously been clipped together.

Both webs 2, 3 comprise perforations (labeled 10, 11 by way of example), i.e. are liquid-permeable. Support 1 is therefore suitable for dewatering a paper web.

The mutually facing sides of webs 2, 3 and of bracing struts 4, 5, 6, 7, 8, 9 are each provided with a coating 12, 13

(depicted continuously in black) that is made of rubber or an elastomer. The material of coatings 12, 13 projects into blind holes (labeled 14 by way of example) that are shaped into bracing struts 4, 5, 6, 7, 8, 9.

Non-woven layers can be applied onto the externally located upper and lower sides of support 1 and attached, for example, using adhesive.

The travel direction of a support 1 of this kind extends perpendicular to the drawing plane. Upon passage through the press section of a paper machine, bracing struts 4, 5, 6, 7, 8, 9 initially rest with no great pressure against the respectively opposite web 2, 3, and its coating 12, 13. Upon passage through the press nip, the pressure rises, so that coatings 10, 11 in the region of bracing struts 4, 5, 6, 7, 8, 9 are elastically compressed so that the overall thickness of support 1 decreases correspondingly. After the press nip, a recovery occurs into the initial position because of the spring effect of coatings 12, 13. The open volume between the two webs 2, 3 is thereby abruptly increased, with the consequence that liquid is drawn back into perforations 12, 13 into the open interior. With appropriate adjustment of the elasticity of coatings 12, 13, this effect occurs so quickly that water flows back into the open volume between webs 2, 3 and is retained until the paper web has lifted away from support 1. As a result, any re-wetting of the paper web is minimized and the overall degree of dewatering is thus increased.

I claim:

1. A liquid permeable support usable as paper machine clothing in a press section of a paper machine, the support comprising:

a first ply having a first elongated support and a first plurality of bracing struts extending from said first elongated support;

a second ply having a second elongated support and a second plurality of bracing struts extending from said second elongated support, the second plurality of bracing struts engaging the first plurality of bracing struts to couple the first and second plies together and form one or more spacings therebetween; and an elastic coating applied to at least one of said first and second plies where the first and second plies brace each other to elastically contract the one or more spacings when pressure is applied to said first and second plies and elastically expand the one or more spacings when pressure is removed from said first and second plies.

2. The support of claim 1, wherein said first and second elongated supports include a plurality of perforated slits disposed therein.

3. The support of claim 1, wherein said first and second bracing struts have a mushroom shape with a narrow portion extending from the corresponding elongated support and a wide tip portion extending from an end of said narrow portion, said wide tip portion being gradually curved.

4. The support of claim 3, wherein said wide tip portions of said first and second pluralities of bracing struts engage each other to prevent said first and second plies from being separated.

5. The support of claim 1, wherein at least one of the first and second bracing struts includes a notch disposed therein, said notch extending perpendicular to said first and second elongated supports and having an elastic material filled therein.

6. The support of claim 5, wherein said notch extends into the bracing strut along a lengthwise axis of the corresponding bracing strut.

7. The support of claim 1, wherein each of said first and second plies includes a rear side facing away from the bracing struts and an engaging side opposite to said rear side and from which the bracing struts extend, said engaging sides of each of said first and second plies having the elastic coating disposed thereon and said rear sides of each of said first and second plies not having the elastic coating thereon.

8. The support of claim 1, wherein said first and second plies, including said first and second elongated support portions and said first and second pluralities of bracing struts, are comprised of extruded plastic webs.

9. The support of claim 1, wherein said elastic coating comprises rubber.

10. The support of claim 1, wherein said elastic coating comprises an elastomer.

11. The support of claim 1, wherein said first and second plies are made of at least one of polyamide-6, -6,6,10, -6,12, -12, and PTT.

12. The support of claim 1, wherein said first plurality of bracing struts extend from said first elongated support to contact said second elongated support at corresponding first contact areas, and said second plurality of bracing struts extend from said second elongated support to contact said first elongated support at corresponding second contact areas, said elastic coating being applied at said first and second contact areas.

13. The support of claim 1, wherein said one or more spacings comprise a plurality of spacings disposed between each of said first and second bracing struts.

14. A liquid permeable support, comprising:

a first ply having a first elongated support and a first plurality of bracing struts extending from said first elongated support; and a second ply having a second elongated support and a second plurality of bracing struts extending from said second elongated support, the second plurality of bracing struts engaging the first plurality of bracing struts to couple the first and second plies together and form one or more spacings therebetween, wherein said first and second plies have corresponding contact side portions from which the corresponding first and second pluralities of bracing struts extend to engage each other and corresponding non-contact side portions opposite to the corresponding contact side portions, said contact side portions being made of a contractable and expandable elastic material and said non-contact side portions being made of a non-elastic plastic.

15. A liquid permeable support usable as paper machine clothing in a press section of a paper machine, the support comprising:

a first ply having a first elongated support and a first plurality of bracing struts extending from said first elongated support;

a second ply having a second elongated support and a second plurality of bracing struts extending from said second elongated support, the second plurality of bracing struts engaging the first plurality of bracing struts to couple the first and second plies together and form one or more spacings therebetween; and an elastic coating applied to at least one of said first and second plies where the first and second plies brace each other; and a plurality of perforations in said first and second elongated supports and said elastic coating, wherein said elastic coating causes the one or more spacings to elastically contract when pressure is applied to said first and second plies, and said elastic coating causes the one or more spacings to elastically expand when pressure is removed from said first and second plies.

16. The support of claim 15, wherein said perforations are arranged along first and second elongated supports in between said bracing struts, and said elastic coating is applied along said first and second elongated supports in between said bracing struts.

* * * * *